US008076597B2

(12) United States Patent
Puri et al.

(10) Patent No.: US 8,076,597 B2
(45) Date of Patent: Dec. 13, 2011

(54) ACTUATOR FOR ACTUATING A SAFETY SWITCH

(75) Inventors: Werner Puri, Nürnberg (DE); Joachim Seidl, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 206 days.

(21) Appl. No.: 12/308,686

(22) PCT Filed: Jun. 30, 2006

(86) PCT No.: PCT/DE2006/001137

§ 371 (c)(1),
(2), (4) Date: Dec. 22, 2008

(87) PCT Pub. No.: WO2008/000199

PCT Pub. Date: Jan. 3, 2008

(65) Prior Publication Data

US 2009/0189463 A1 Jul. 30, 2009

(51) Int. Cl.
*H01H 27/00* (2006.01)

(52) U.S. Cl. ..... 200/43.04

(58) Field of Classification Search ..... 200/329, 200/330, 332.1, 334, 43.04, 43.07
See application file for complete search history.

(56) References Cited

U.S. PATENT DOCUMENTS

| | | | | |
|---|---|---|---|---|
| 5,662,212 | A * | 9/1997 | Wecke et al. | 200/329 |
| 5,744,767 | A * | 4/1998 | Wecke et al. | 200/17 R |
| 5,918,731 | A * | 7/1999 | Wecke et al. | 200/329 |
| 6,949,712 | B1 | 9/2005 | O'Donnell | |

FOREIGN PATENT DOCUMENTS

| | | |
|---|---|---|
| DE | 295 16 230 | 12/1995 |
| DE | 101 23 943 | 7/2002 |
| DE | 101 16 054 | 10/2002 |
| DE | 10116054 A1 * | 10/2002 |

* cited by examiner

*Primary Examiner* — Felix O Figueroa
(74) *Attorney, Agent, or Firm* — Harness, Dickey & Pierce, P.L.C.

(57) ABSTRACT

An actuator is disclosed for actuating a safety switch. In at least one embodiment, the actuator includes a fixing element, an actuating element, and a connection arrangement for connecting the elements. A technical method is disclosed which proposes a universally applicable and low-cost activator. To this end, in at least one embodiment, the connection arrangement is implemented with at least one elastic element, which is pretensioned by way of at least one pretensioning element. Due in particular to the internal mounting of the pretensioning element inside the elastic element, a very simple and robust structure of the connection arrangement is achieved.

19 Claims, 2 Drawing Sheets

ACTUATOR FOR ACTUATING A SAFETY SWITCH

PRIORITY STATEMENT

This application is the national phase under 35 U.S.C. §371 of PCT International Application No. PCT/DE2006/001137 which has an International filing date of Jun. 30, 2006, which designated the United States of America, the entire contents of which are hereby incorporated herein by reference.

FIELD

At least one embodiment of the invention generally relates to an actuator for actuating a safety switch. In at least one embodiment, the actuator includes a fixing element, an actuating element and a connection arrangement provided for connecting the fixing element to the actuating element. At least one embodiment of the invention also generally relates to a safety switch having an actuator of the aforesaid kind.

BACKGROUND

Safety switches are generally used to force the activation or deactivation of an electrical power supply. The fields of application of safety switches are legion. In the industrial as well as in the private domain, application scenarios such as, for example, a guard door, a protective cover, a safety fence or similar arrangements can be implemented with the aid of a safety switch.

In the present prior art safety switches of this kind have a basic structure, hereinafter also referred to as a housing, and a separate actuator. The reason for this two-part implementation is to be found in the way in which the safety switch is used. The separate actuator and the housing are mounted on separate mechanical units in order to be brought together for a specific operating state. Thus, for example, the separate actuator could be mounted on a movable door, whereas the housing of the safety switch could be fixed to a wall or a door frame.

The basic structure of the safety switch has a drive head and can be of single- or multipart design. Furthermore the switching contacts are arranged in the basic structure. The drive head has one or more openings into which the actuator is introduced in order, for example, to close opener contacts.

In the safe system state, which is given when the danger zone is screened off by way of a protective device, the actuator is located inside the drive head. If, for example, a guard door on which the actuator is disposed is opened, the actuator is extracted from the drive head, causing the system to be switched off, or placed in a safe state, as a result of the forced opening of the opener contact. If the system cannot easily be switched off or, as the case may be, the danger associated therewith cannot easily be eliminated, the safety switch can also be provided for the purpose of locking the guard door.

The precise insertion of the actuator proves problematic in the case of the mechanical actuation of the drive head by way of the actuator. Reliable introduction of the actuator into the drive head must therefore be ensured under mechanical load and the actuating function reliably triggered in spite of any deviations from the provided insertion path. This tolerance problem arises due to the fact that the drive head and the separate actuator are mounted on different carriers which allow a certain amount of play. This problem is generally exacerbated with exposure of the safety switch to wear and tear, as a result of improper handling of the protective device or due to deficient assembly right at the time of commissioning. It can be assumed that in the standard case the separate actuator has an unavoidable offset with respect to the insertion opening of the drive head. With the actuator inserted, therefore, the actuator must be able to be aligned in accordance with the insertion opening of the drive head.

Introduction of the actuator at an angle in the case of cover-like protection objects constitutes a further problem. This problem is based on the fact that protective covers, for example, are not actuated in a linear manner, as are sliding doors for example. The movement of a protective cover corresponds to a partial rotational movement about a rotational axis which is mostly determined by way of hinges. Consequently it must be possible for the actuator to be inserted into the drive head at a certain angle that requires to be set beforehand. In this way it is ensured that upon reaching an end position in the drive head the actuator is aligned with respect to the same in an operationally correct manner.

Flexible mounting of an actuator by way of rubber bushings likewise proves problematic. For example, actuators are often secured to a mounting surface by way of two screws, with the actuator plate being flexibly mounted by way of rubber bushings and consequently only being able to compensate to a very limited extent for tolerances between, for example, a guard door and a frame. Because the drilled holes in the actuator plate are typically very much larger than the screw heads of the fixing screws, actuators of this kind must generally be mounted by way of large-sized retaining washers. If the ratio of retaining washer to drilled hole in the actuator plate does not correspond (the retaining washer could be too small, for example), the rubber bushings can be moved over the screw head, thereby creating a safety risk. A further disadvantage with actuators of this kind is that a desired preferred direction can only be pretensioned with considerable overhead.

DE 295 16 230 U1 discloses a radius actuator which is mounted on an elaborate base member. Because of its base member the actuator's possible tolerance compensation is very limited. A lateral offset is not possible and in addition the base member has a large number of components.

SUMMARY

At least one embodiment of the invention is directed to a simple and universally usable actuator which allows tolerance compensation in any directions.

At least one embodiment of the invention includes an actuator wherein the connection arrangement has at least one resilient element which is pretensioned by way of at least one pretensioning element for the purpose of connecting the fixing element to the actuating element. A safety switch is further disclosed.

At least one embodiment of the inventive actuator for actuating a safety switch has a fixing element, an actuating element and a connection arrangement for connecting the fixing element to the actuating element. The connection arrangement also has at least one resilient element which is pretensioned by way of at least one pretensioning element for the purpose of connecting the fixing element to the actuating element. In this arrangement the function of the pretensioning element is to be responsible for pretensioning the resilient element between the fixing element and the actuating element. The pretensioning element and optionally also the resilient element are provided in order to allow alignment in the actuating direction, whereby the resilient element ensures a flexible offset or deflection of the connection arrangement on all sides. The rigidity of the connection arrangement that is necessary for actuation purposes can be realized by the pretensioning element, by the resilient element or by both elements together.

In an advantageous embodiment the actuating element is mounted on the fixing element in a spring-loaded manner by way of the resilient element. In this arrangement the forced opening prescribed for the safety switch is ensured by way of the rigidity of the pretensioning element. In this case there is a clear division of the tasks of the two elements which is advantageous when it comes to selecting the components.

In an advantageous embodiment it is possible to pretension the resilient element for tension or compression by way of the pretensioning element. As a result the actuator is always in a defined position. Through the combination of these two elements the actuator can advantageously be deflected laterally, compressed, twisted, offset in parallel and/or bent. An actuator constructed in this way can move at will in all axes and thus offers a maximum of tolerance compensation.

Advantageously, the pretensioning element is permanently connected to the actuating element and the fixing element, thereby enabling stresses such as impacts, shocks or similar to be absorbed by way of a, for example, single-piece embodiment and avoiding a breaking-off of the actuator. If the resilient element should nonetheless break due, for example, to heavy wear and tear or severe stress, the actuating element is still connected to the fixing element by way of the pretensioning element, with the result that misuse or a malfunction can be ruled out.

In an advantageous embodiment the pretensioning element is disposed inside the resilient element. As a result of this arrangement it is ensured that the force reaction is similarly great for anticipated directions of force application. The actuator reacts with the same counterforce for different directions of force application. Furthermore the structure of the connection arrangement is kept very simple, resulting in a cost saving owing to the small number of components.

The resilient element and the pretensioning element are advantageously embodied as a single piece, with the resilient properties of the single-piece embodiment varying radially, which is to say substantially perpendicularly with respect to the actuating direction. Thus, for example, it is conceivable for the material density of the connection arrangement to decrease continuously or in stages from the inside to the outside.

Advantageously, the actuator has a mechanism for presetting the actuating direction of the actuating element. In this way it is possible, for example, to provide a presetting mechanism between connection arrangement and actuating element, or between connection arrangement and fixing element, which presetting mechanism can be set as appropriate according to the application. This enables the actuator to be employed universally for any conceivable application, effectively as a radius actuator or universal actuator. Optionally it is possible to provide already preset angles for a quite specific application ex works so that the user is no longer able to modify this angle.

In an advantageous embodiment a specific angle of the actuating element or a specific actuating direction can be set by changing the position of the resilient element and the actuating element relative to each other. In this case an actuating direction can be set by the user, or be presettable ex works. To avoid unnecessary material overhead, use is made of the already available elements (actuating element and resilient element) in order to achieve an angular adjustment of the actuating element in addition. This could be accomplished for example by modifying or shifting the points of contact of the resilient element on the fixing element, on the actuating element and/or on an actuator plate that the actuating element has.

Further advantageous embodiments and preferred developments of the invention can be derived from the description of the figures and/or from the dependent claims.

BRIEF DESCRIPTION OF THE DRAWINGS

The invention is described and explained in more detail below with reference to the example embodiments depicted in the figures, in which.

DETAILED DESCRIPTION OF THE EXAMPLE EMBODIMENTS

Figure 1:
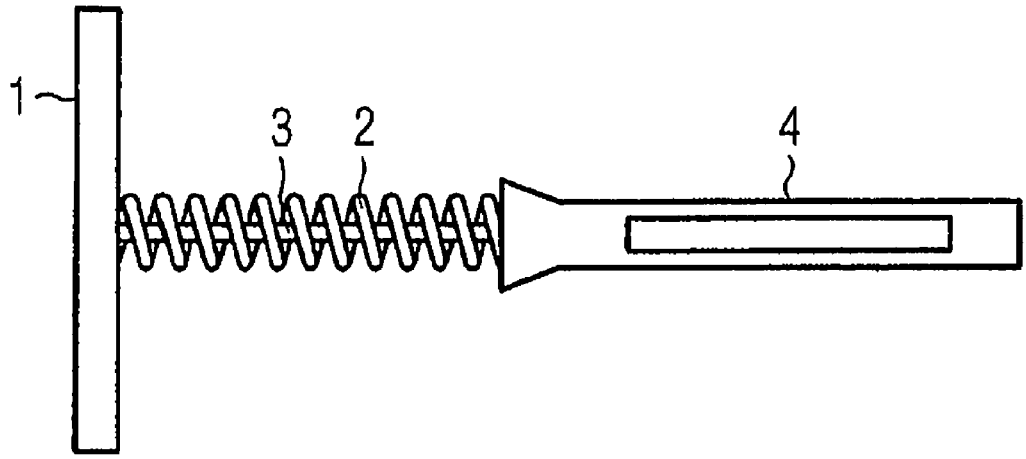
FIG. 1 shows a first example embodiment of an actuator having a steel cable pretensioner.

FIG. 1 shows a first example embodiment of an actuator having a steel cable as a pretensioning element. The actuator has an actuator tip 4 as actuating element and a fixing element embodied as a baseplate 1 as fixing element. The connection arrangement between the said elements is realized by way of a resilient element which is embodied as a compression spring 2 and a pretensioning element which is embodied as a steel cable 3.

The compression spring 2 and the steel cable 3 constitute simple yet low-cost components which realize a connection arrangement that effects a compensating movement in substantially all directions and also allows a maximum of tolerance compensation. In addition it is possible to absorb stresses that are produced as a result of impacts or shocks.

Advantageously, the actuator has only one resilient element, i.e. the compression spring 2, which is the only element that is subject to heavy wear and tear. Even if the spring breaks off due to severe stress or heavy wear and tear, the safety function during extraction of the actuator is not compromised. In addition any damage is instantly recognizable.

Figure 2:
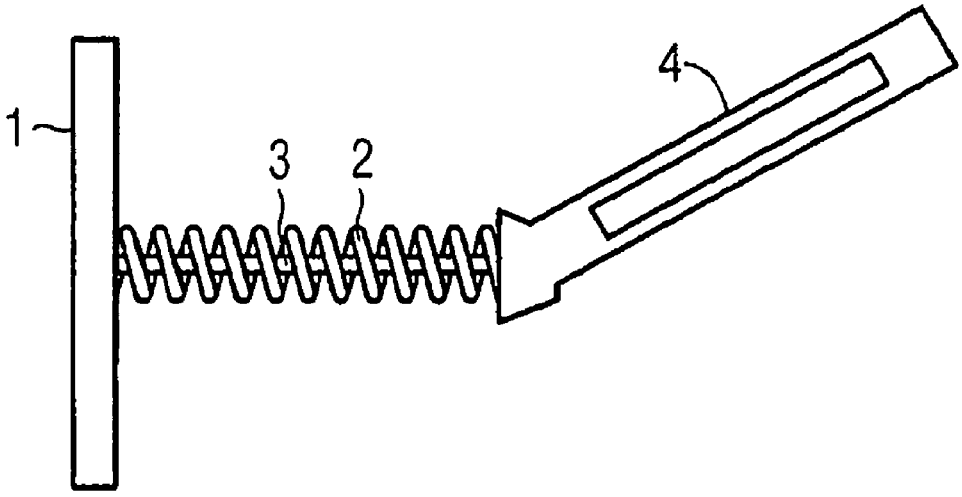
FIG. 2 shows a second example embodiment of a preset actuator.

FIG. 2 shows a second example embodiment of a preset actuator. As in the first example embodiment the actuator has a baseplate 1, a compression spring 2, a steel cable 3 and an actuator tip 4, the actuator tip 4 being preset in the actuating direction. This presetting is permanent in this example embodiment, in other words it is preset ex works. The user has no possibility of tampering with the actuator, as a result of which misuse can be ruled out.

Owing to, the presetting of the actuator and also owing to its flexibility, an unnecessarily great application of force onto the drive head mechanism of the switch can advantageously be avoided.

Depending on the application of the safety switch it can also be advantageous to carry out the presetting between the fixing element embodied as the baseplate 1 and the connection arrangement 2, 3, with the presetting being permanently preset or modifiable by the user.

An alignment of the actuator tip 4 selectable by the user can be realized for example by way of a screw arresting mechanism.

Figure 3:
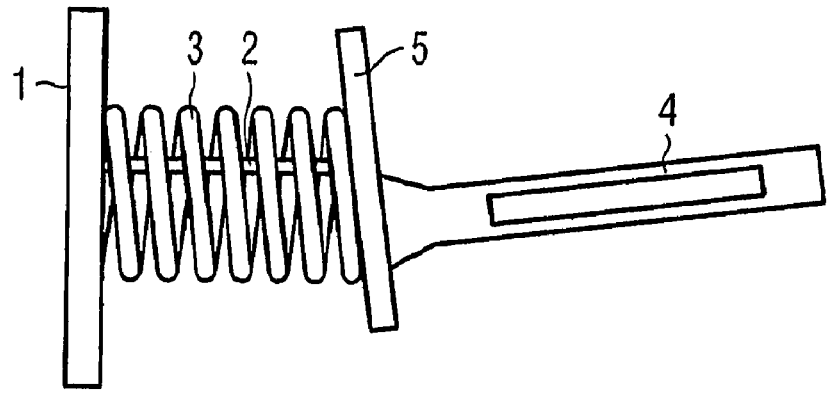
FIG. 3 shows a third example embodiment of an angularly adjustable actuator in a first position.

FIG. 3 shows a third example embodiment of an angularly adjustable actuator in a first position. Compared to the first two example embodiments, the actuator of this example embodiment has an actuator plate 5 disposed between the actuator tip 4 and the connection arrangement 2, 3, on which actuator plate 5 the actuator tip 4 is mounted non-centrally. The non-central position is not compulsory in this arrangement. A central position, apposition close to the edge or similar positions can also be advantageous depending on the geometry favored by the particular application. An angular setting of the actuator tip 4 can be set by way of a specific selection of the points of contact of the compression spring 2 and/or of the steel cable 3 on the actuator plate 5, with the steel cable 3 and the compression spring in each case assuming a different position relative to each other for different angles.

The steel cable 3 is installed non-centrally inside the compression spring 2, with the actuator plate 5 together with the actuator tip 4 inclining in the direction that is predefined by the shortest distance between the steel cable 3 and the compression spring 2.

Figure 4:
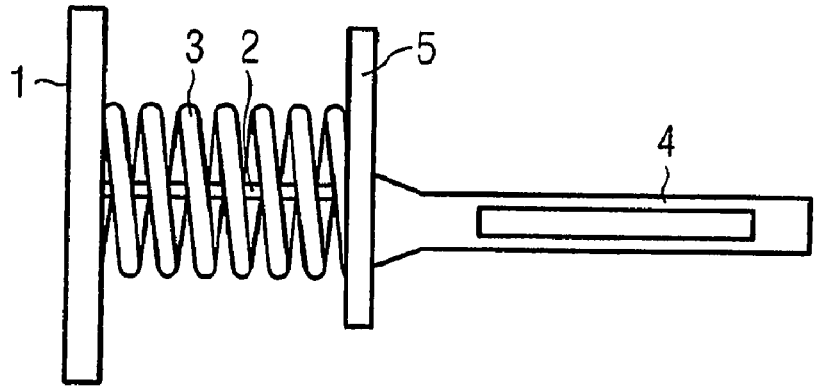
FIG. 4 shows a fourth example embodiment of an angularly adjustable actuator in a second position.

FIG. 4 shows a fourth example embodiment of an angularly adjustable actuator in a second position. As already stated in relation to the preceding example embodiments, this example actuator can also be used as an actuator that is preset for a specific actuating direction.

However, this second position which the actuator assumes could also represent a starting position for an actuator whose actuating direction setting can be set variably, for example by the user, by modifying the points of contact described in FIG. 3. In that way the third, fourth and the following fifth example embodiment would be combined in a kind of universal actuator which can be used in an application-specific manner for different actuating devices.

Figure 5:
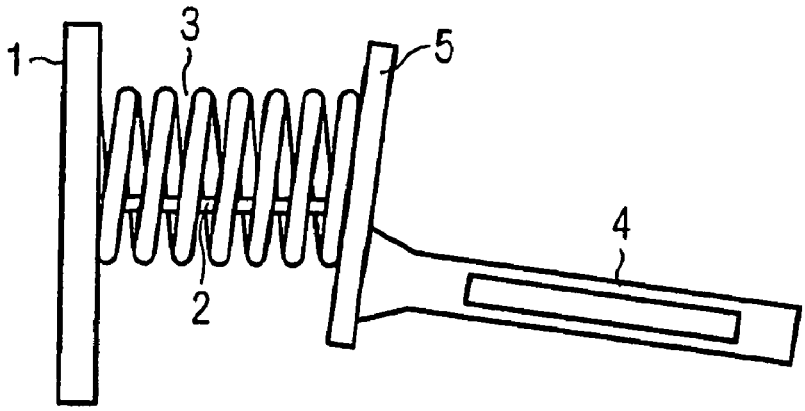
FIG. 5 shows a fifth example embodiment of an angularly adjustable actuator in a third position.

The example embodiments three, four and five could be combined into a single embodiment if the relative position of the compression spring 2 to the steel cable 3 is implemented in a variable manner and the actuating directions of FIGS. 3 to 5 can be realized by a change of setting. With this type of universal radius actuator this could be achieved for example on the one hand by way of a steel cable mounted on at least one disk, the position of the cable being modifiable by way of the disk. Advantageously, said disk is implemented as rotatable. In addition the compression spring 2 can be embodied for the purpose of changing the setting in that for example recesses, such as, for example, grooves, in particular annular grooves, provided for receiving the spring are disposed on the baseplate 1 and/or on the actuator plate, the respective groove defining a new point of contact or a different actuator direction.

FIG. 5 shows a fifth example embodiment of an angularly adjustable actuator in a third position. The statements made in relation to FIG. 3 and FIG. 4 can be applied analogously.

To sum up, at least one embodiment of the invention relates to an actuator for actuating a safety switch, the actuator having a fixing element, an actuating element and a connection arrangement for connecting the elements. A technical teaching is disclosed which proposes a universally usable and low-cost actuator. Toward that end, the connection arrangement is realized by way of at least one resilient element which is pretensioned by way of at least one pretensioning element. A very simple and robust structure of the connection arrangement is produced in particular as a result of the internal mounting of the pretensioning element inside the resilient element.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An actuator for actuating a safety switch, said actuator comprising:

a fixing element;

an actuating element; and a connection arrangement connected directly to a surface of the fixing element at a first end of the connection arrangement and connected to the actuating element at a second end of the connection arrangement, the connection arrangement including at least one resilient element, pretensioned by way of at least one pretensioning element, to connect the fixing element to the actuating element, wherein each component of the connection arrangement is directly connected to the surface of the fixing element.

2. The actuator as claimed in claim 1, wherein the pretensioning element is permanently connected to the actuating element and the fixing element.

3. The actuator as claimed in claim 1, wherein the resilient element is provided to allow a flexible changing of a position of the actuating element in relation to the fixing element when force is applied.

4. The actuator as claimed in claim 1, wherein the connection arrangement is provided to absorb applications of force on the actuating element at least one of along and perpendicularly with respect to an actuating direction.

5. The actuator as claimed in claim 1, wherein the pretensioning element is arranged inside the resilient element.

6. The actuator as claimed in claim 1, wherein the pretensioning element is a steel cable, a wire or a pin.

7. The actuator as claimed in claim 6, wherein the pin is at least one of movable and resilient.

8. The actuator as claimed in claim 1, wherein the resilient element is a spring.

9. The actuator as claimed in claim 1, wherein at least one of the actuating element and the fixing element pretensions the resilient element.

10. The actuator as claimed in claim 1, wherein the actuator has an actuating direction setting mechanism that sets an actuating direction of the actuating element.

11. The actuator as claimed in claim 10, wherein the actuating direction setting mechanism has different actuating directions in the case of different arrangements of the actuating element relative to the resilient element.

12. The actuator as claimed in claim 10, wherein the actuating direction setting mechanism is disposed between actuating element and connection arrangement or between the fixing element and the connection arrangement.

13. A safety switch including an actuator as claimed in claim 1.

14. The actuator as claimed in claim 2, wherein the connection arrangement is provided to absorb applications of force on the actuating element at least one of along and perpendicularly with respect to an actuating direction.

15. An actuator for actuating a safety switch, said actuator comprising:

a fixing element;

an actuating element; and means for connecting the fixing element to the actuating element, the means for connecting including at least one resilient element, pretensioned by way of at least one pretensioning element, for connecting the fixing element to the actuating element at opposing ends of the connecting means, wherein the pretensioning element is directly connected to each of the fixing element and the actuating element.

16. The actuator as claimed in claim 15, wherein the resilient element is provided to allow a flexible changing of a position of the actuating element in relation to the fixing element when force is applied.

17. An actuator for actuating a safety switch, said actuator comprising:

a fixing element;

an actuating element; and means for absorbing applications of force on the actuating element at least one of along and perpendicularly with respect to an actuating direction, the means for absorbing including at least one resilient element, pretensioned by way of at least one pretensioning element, the means for absorbing being connected to the fixing element and to the actuating element at opposing ends of the absorbing means, wherein the pretensioning element is directly connected to the fixing element.

18. The actuator as claimed in claim 17, wherein the pretensioning element is arranged inside the resilient element.

19. The actuator as claimed in claim 17, wherein the resilient element connects the fixing element and the actuating element.

* * * * *